United States Patent [19]

Hautemont

[11] Patent Number: 4,811,550

[45] Date of Patent: Mar. 14, 1989

[54] METHOD AND DEVICE FOR MANUFACTURING AND POSITIONING UPON A CONTAINER AN UNDERCUT THERMOPLASTIC LID, AND CONTAINER PROVIDED WITH SUCH A LID

[75] Inventor: Jean-Claude Hautemont, Gif-Sur-Yvette, France

[73] Assignee: Erca Holding, Les Ulis, France

[21] Appl. No.: 66,980

[22] Filed: Jun. 29, 1987

[30] Foreign Application Priority Data

Jul. 2, 1986 [FR] France ..... 86 09631

[51] Int. Cl.[4] ..... B65B 7/28; B65B 51/10

[52] U.S. Cl. ..... 53/478; 53/488; 53/297; 53/300; 53/329

[58] Field of Search ..... 53/478, 488, 487, 297, 53/298, 300, 329, 441, 556

[56] References Cited

U.S. PATENT DOCUMENTS

| | | | |
|---|---|---|---|
| 2,012,529 | 8/1935 | Eudredge | 53/488 X |
| 3,688,464 | 9/1972 | Fox | 53/488 X |
| 3,724,161 | 9/1973 | Vermeulen | 53/488 |
| 4,282,699 | 8/1981 | Embro | 53/298 |
| 4,362,002 | 12/1982 | Rowland | 53/297 X |

FOREIGN PATENT DOCUMENTS

| | | | |
|---|---|---|---|
| 649756 | 10/1962 | Canada | 53/488 |
| 447447 | 5/1936 | United Kingdom | 53/297 |

*Primary Examiner*—John Sipos

*Attorney, Agent, or Firm*—Dennison, Meserole, Pollack & Scheiner

[57] ABSTRACT

The present invention relates to a method for manufacturing and positioning upon a container, an undercut thermoplastic lid, made from a thermoplastic band.

According to the invention, in said method the upper part of the container support as well as the upper part of the container which extends from the upper end of said container support are used as stamping die or male forming mold, and the part of thermoplastic band defined by the lower edge of the bell is applied against the outer face of the upper parts of the container and of its support under a gas excess pressure created inside an enclosure closed and defined by the ball and the thermoplastic band.

14 Claims, 4 Drawing Sheets

METHOD AND DEVICE FOR MANUFACTURING AND POSITIONING UPON A CONTAINER AN UNDERCUT THERMOPLASTIC LID, AND CONTAINER PROVIDED WITH SUCH A LID

FIELD OF THE INVENTION

The present invention relates to a method and device for manufacturing and positioning upon a container an undercut thermoplastic lid, and to a container provided with such a lid.

BACKGROUND OF THE INVENTION

Some of the conventional undercut thermoplastic lids, and in particular lids destined to act, first as an over-lid covering over the lid sheet sealed on the container, and then as a permanent lid after the destruction of the lid sheet, are prefabricated by thermoforming in a thermoplastic band, with a mold of suitable shape, and are thereafter cut from the thermoplastic band before being fixed on the corresponding containers by screwing or snap-fitting.

The dimensions of these lids vary from one batch of lids to another. Variations in the dimensions may be due to the use of different basic materials having different degrees of shrinkage. Furthermore, the dimensions of the edges of the thermoplastic containers are also prone to variations. It has been found that wear of the equipment used for producing the lids and the containers and for cutting them, also contributes to such variations in the dimensions. It has also proved difficult to correctly center the prefabricated lids with respect to the edge of the containers.

SUMMARY OF THE INVENTION

It is the object of the present invention to eliminate these disadvantages and to propose a method and device for manufacturing and positioning an undercut thermoplastic lid over a container which permit instant adaptation of the lid over the corresponding container without having to make allowance for the variations in dimensions compared with the containers average dimensions.

In a method for manufacturing a lid from a thermoplastic band, using a forming bell, a holding clamp for clamping an annular area of the thermoplastic band against the lower annular edge of the forming bell, and a stamping die or male forming mold, located inside the volume defined by said bell and pushing the part of band delimited by said bell, this object is reached according to the invention due to the fact that the upper part of the container support as well as the upper part of the container which extends from the upper end of said container support are used as stamping die or male forming mold, and the part of thermoplastic band defined by the lower edge of the bell is applied against the outer face of the upper parts of the container and of its support under a gas excess pressure created inside an enclosure closed and defined by the bell and the thermoplastic band.

Due to this concept, the lid or over-lid takes on the exact the shape of the upper end of the container and is already fitted over it at the end of the thermoforming operation.

According to another advantageous feature of the invention, the lid molded on the container and the upper part of the container support is cut from the thermoplastic band while it is still under the forming bell.

This step eliminates the need of re-centering the container and the over-molded lid with respect to a cutting tool.

The device for manufacturing and positioning an undercut thermoplastic lid which comprises a forming bell provided with a lower annular edge and connections with a source of pressurized gas,and a lower holding clamp adapted to apply an annular area of a preheated thermoplastic band against the lower face of said lower annular edge, is characterized in that it comprises, under the bell and inside the inner periphery of the lower edge thereof, an annular container support of which the upper part, which is partly overhung by the upper end of the container, also acts as a stamping die or male forming mold for the marginal part of the lid to be thermoformed.

Owing to this particular concept, the thermoformed lid is automatically adapted to the shape of the container to be covered.

BRIEF DESCRIPTION OF THE DRAWINGS

The invention will be more readily understood on reading the following description with reference to the accompanying drawings in which.

DETAILED DESCRIPTION OF THE INVENTION

Figure 1:
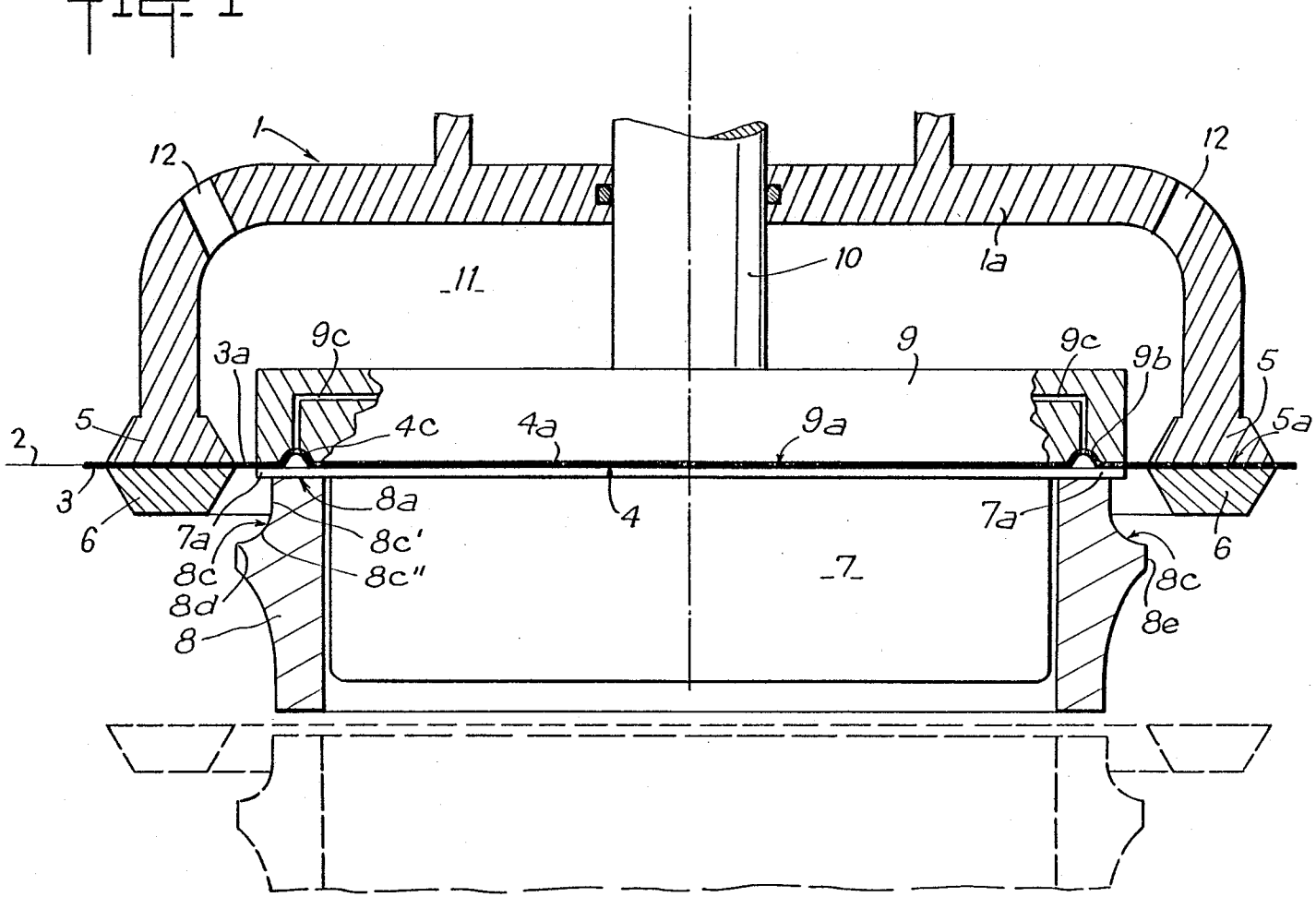
FIG. 1 is an elevational view of an axial vertical section through the device for manufacturing and positioning a thermoplastic lid, the different elements of the device being in a position ready for thermoforming.

As illustrated in the drawings, the device for manufacturing and positioning an undercut thermoplastic lid comprises a forming bell 1 placed above the horizontal plane 2 defined by the horizontal path of a thermoplastic band 3 in which lids or overlids, also called undercut lids, will be thermoformed. The lower end of the forming bell has a widened annular edge 5 of which the lower face **5*a* is flat and horizontal and is used as a rest for an annular zone of the thermoplastic band 3 when said zone is applied against said lower face 5*a* by means of an annular holding clamp 6 provided under the horizontal plane 2 so as to be vertically movable between a high position in which it applies the thermoplastic band 3 against the edge 5 of the forming bell 1 and a lower position (illustrated in broken lines in FIG. 1) in which a container 7 can be brought laterally under the thermoplastic band 3 and the bell 1**.

Figure 10:
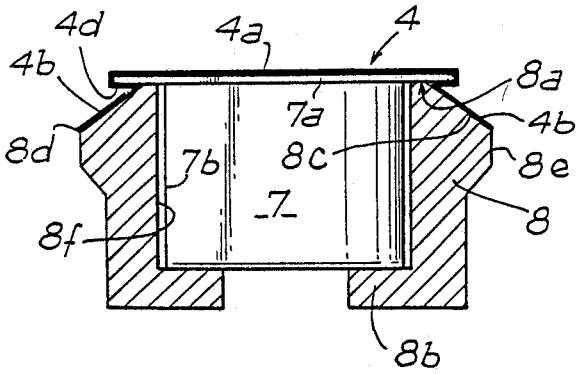
FIG. 10 shows a container support and its corresponding container for the production of an inviolable lid.

The device according to the invention further comprises, under the thermoplastic band 3 and inside the inner periphery of the lower edge 5 of the bell 1, and consequently also inside the inner periphery of the holding clamp 6 which preferably coincides vertically with said lower edge 5, a container support 8 which comprises a housing receiving the container 7 and which supports said container 7, either by its upper lateral edge 8*a* (FIGS. 1 to 7), or by its lower end 8*b* (FIG. 8), or else by its upper edge 8*a* and its lower end 8*b* (FIG. 10). This container support 8 is also vertically movable between, first a high posiiton in which said support penetrates, at least by its upper part of which the outer face 8*c* has the shape of a skirt widening out downwardly and outwardly, as far as an annular shoulder 8*d*, thus constituting a stamping die or male forming mold inside the enclosure of the bell 1 (FIG. 2), and second, a low position (see FIG. 1, support in broken lines) in which a container 7 can be loaded laterally and through the top into container support 8.

In the bell 1 is provided a support plate 9 which covers all the zone of the thermoplastic band 3 situated opposite the container 7 and defined by the upper edge 7*a* of the latter. Thus, the periphery of the upper end of container 7 normally coincides with the periphery of the support plate 9 placed above the horizontal plane 2 and more generally of the thermoplastic band 3. Said support plate 9 is vertically movable inside the bell 1 between, on the one hand, a high position in which the annular part 3*a* of the thermoplastic band 3, which part 3*a* is comprised between the lower edge 5 of the bell 1 or the corresponding clamping member 6 and the edge of the support plate 9 or the upper edge 7*a* of the container 7, is stretched (FIG. 2) with respect to its initial radial length (FIG. 1) or else is cut from the rest of the thermoplastic band 3 (FIG. 3), and on the other hand, a low position in which the lower face 9*a* of the support plate 9 is situated on the level of the lower horizontal face 5*a* of the lower edge 5 of bell 1 (FIG. 1). The vertical movement of the support plate 9 is controlled by means of a rod 10, fast with the upper face of support plate 9, traversing in tight manner the upper wall 1*a* of the bell 1 and connected to the piston of a control jack not shown. The forming bell 1 can, if required, move vertically of a few millimeters or more in order to clear the moving path of the thermoplastic band 3 as long as this path is situated under the bell 1. In other cases, the bell 1 can be fixedly mounted.

Above the container edge 7*a*, and more particularly opposite the upper end 8*a* of the container support 8, the lower face 9*a* of the support plate 9 is provided with an annular groove 9*b* of which the bottom is connected, via a plurality of suction channels 9*c*, to a vacuum pump, not shown. On the contrary, enclosure 11 defined by the forming bell 1 and the thermoplastic band 3 gripped between the lower edge 5 of the bell 1 and the holding clamp 6 (FIG. 1) is connected via a plurality of orifices 12 provided in the wall of bell 1, and via a control valve, with a source of pressurized gaseous fluid, both of which are not shown.

The lid 4 is, in general, composed of an upper wall 4*a* and of a lateral skirt 4*b* which, depending on the shape of the upper end of containers 7, can have various configurations.

According to a first embodiment, the upper wall 4*a* of the lid 4 presents, in its marginal part, an annular reinforcing rib 4*c* obtained by suction of the thermoplastic material situated opposite the annular groove 9*b* which is connected with the suction channel 9*c*, which channels are in turn connected via a control valve to a vacuum pump. Said annular rib 4*c* is thermoformed when the thermoplastic band 3 is gripped between the edge 5 of the bell 1 and the holding clamp 6 and when the horizontal flat edge 7*a* of the container 7 and the corresponding part of the thermoplastic band preheated to the forming temperature are held between support plate 9 in low position and container support 8 in intermediate position (FIG. 1). Obviously, throughout the forming of the reinforcing rib 4*c* of the lid 4, the assembly consisting of the container support 8, the container 7, the part of thermoplastic band covering the upper end and in particular the upper edge 7*a* of said container, and the support plate 9, can also be moved upwardly until the lateral annular shoulder 8*d* of container support 8 reaches nearly to the level of the horizontal plane 2 of the thermoplastic band 3 and virtually closes off the base of the bell 1 at the level of the lower face 5*a* thereof (FIG. 2).

Figure 3:
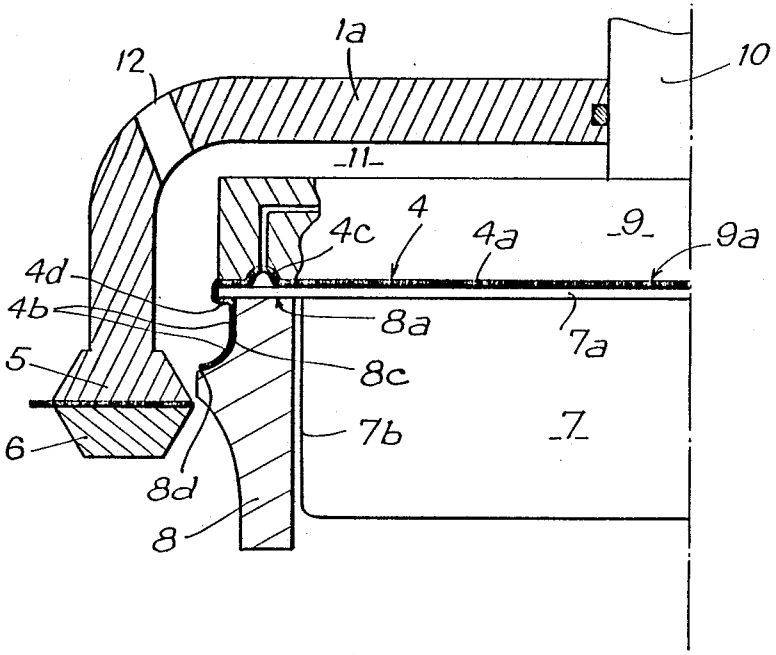
FIG. 3 is an elevational view similar to FIGS. 1 and 2 but showing the different elements of the device in the position in which the lid is completely thermoformed on the container and cut from the thermoplastic band.
Figure 2:
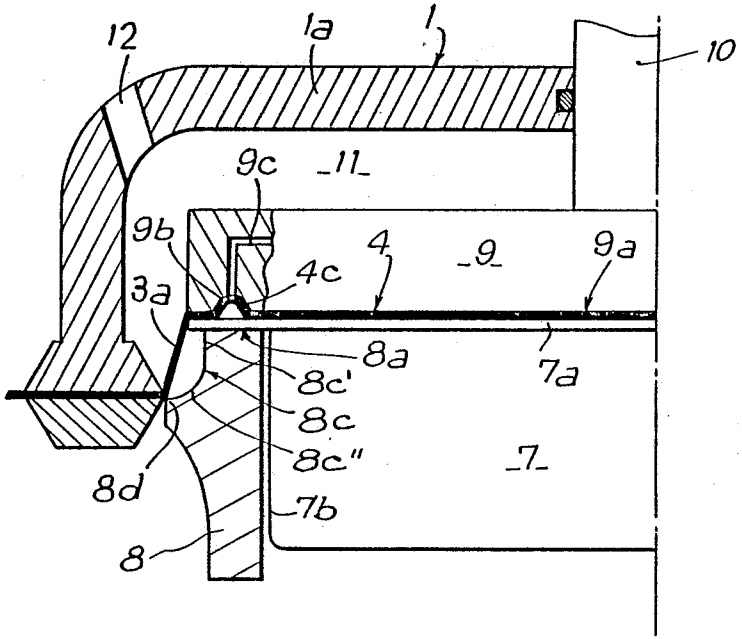
FIG. 2 is an elevational view similar to FIG. 1, but showing the different elements of the device in a position in which the lid is already partly formed.

In the particular embodiment illustrated in vertical section in FIGS. 1 to 3, the skirt-shaped outer face 8*c* of the upper part of the container support 8 has a vertical cylindrical upper part 8*c*′ followed by a widening out lower part 8*c*″ of truncated general shape which joins up with the near-horizontal annular lateral shoulder 8*d*.

In general, horizontal shoulder 8*d* is joined on its periphery with a vertical cylindrical wall 8*e* the periphery of which fits without noticeable lateral play inside the inner periphery of the lower edge 5 of the bell 1, on the one hand, and inside that of the holding clamp 6, on the other hand. When the container support 8 is in the position illustrated in FIG. 2, in which shoulder 8*d* is just below the level of the thermoplastic band 3 gripped between the bell 1 and the holding clamp 6, it is possible to use the upper part 8*c* of the container support 8 as a molding die by feeding a pressurized gas, such as compressed air, into the enclosure 11 of the bell, through orifices 12, thereby applying the annular part 3*a* of the thermoplastic band 3, which part is situated between holding clamp 6 or edge 5 and the support plate 9 and is at the thermoforming temperature, against the edge 7*a* of container 7 and against the outer face or skirt 8*c* of the container support 8 where it will be immediately solidified under the cooling effect caused by its contacting with the cold container support 8.

Once the lid 4 is thermoformed on the edge 7a of the container and on the outer face 8*c* of the upper part of the container support 8, it should be possible to eject the lid 4 together with the container 7 which is joined thereto due to the fact that at least certain parts 4*d* of the lid 4 are undercut-molded and are applied against part of the lower face of the horizontal edge 7*a* of the container. To this effect, it would be necessary to move respectively upwardly and downwardly first the bell 1 and the support plate 9, and second the holding clamp 6 and the container support 8, in order to transfer of one step the assembly composed of container 7, formed lid 4 and thermoplastic band 3 which, at this stage in the operation, is still attached to the formed lid 4. Then the lid 4 has to be cut from the thermoplastic band 3 in a separate cutting station.

In certain cases however, it is more advantageous to provide such cutting station in exactly the same working station as the bell 1. To this effect, the annular shoulder 8*d* of the container support 8 is used as the cutting edge of a movable stamp and the inner edge of the lower end 5 of the bell 1 is used as the counter-cutting edge of a fixed stamping die which cooperates with the cutting edge of said stamp. In this way, the lid 4 is cut or stamped in the thermoplastic band 3 immediately after being formed, at the lower end of its skirt 4b when the annular shoulder 8*d* of container support 8 penetrates into enclosure 11 of the bell 1 and projects upwardly from the level of the lower face 5*a* of the lower edge 5 of the bell 1 (FIG. 3). The assembly consisting of container 7 and lid 4 can then be removed from the bell 1 in a conventional way, by lowering the holding clamp 6 and the container support 8 and removing the container 7.

Figure 4:
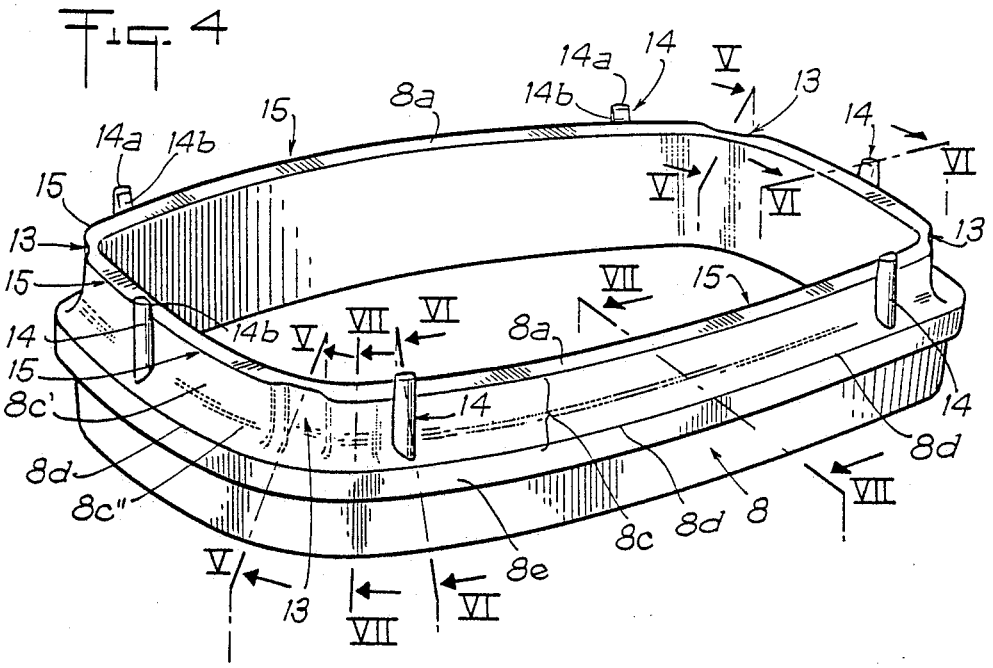
FIG. 4 is a diagrammatical perspective view of the container support forming part of the device according to the invention.
Figure 5:
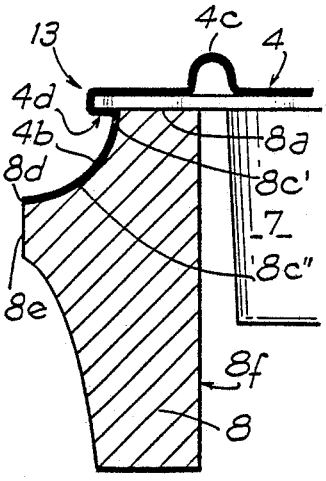
FIGS. 5 to 7 are elevational views of several vertical cross-sections of the container support taken along lines V—V, VI—VI and VII—VII of FIG. 4.
Figure 6:
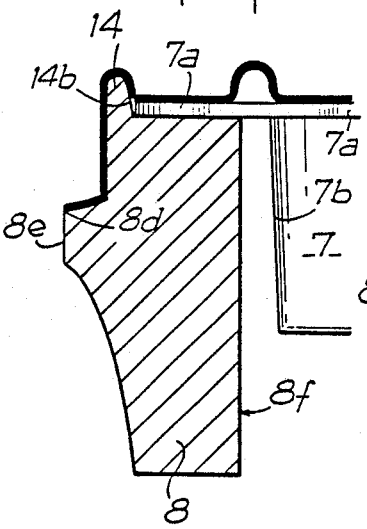
Figure 7:
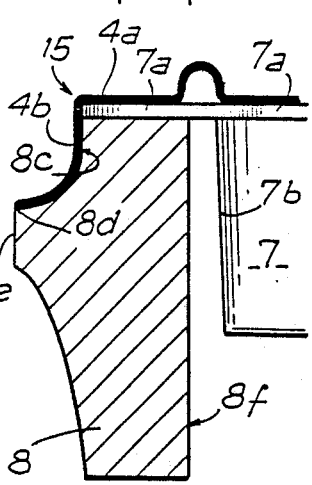

Given that the lid 4 should be removable from the container 7 without being torn, the undercuts 4*d* of lid 4 should be in small number and deformable. The upper part of the container support 8 therefore comprises only in a few areas predetermined as a function of the general shape of the container edge 7*a*, a thickness of wall such that its outer face 8*c*, and more precisely side face 8*c*' which joins up with the horizontal upper face 8*a*, is slightly set back, for example by 0.5 to 2 mm with respect to the vertical face of the container edge 7*a* when a container is placed into said container supports. Such areas permitting the production of an undercut are indicated in FIGS. 4 and 5 by reference 13 (see also cross-section along line V—V, FIGS. 4 and 5).

It is also advantageous to center each container 7 with respect to container support 8 before the container is covered with a lid 4. To this effect, the container support is provided, on its periphery, on the outside of upper horizontal face 8*a* and on the inside of annular shoulder 8*d*, with a number of vertical fingers or lugs 14 comprising at their free end 14*a* which projects of a few millimeters from upper horizontal face 8*a* of the container support 8, an inner centering face 14*b* which is more or less inclined, with respect to the vertical, from the top downwards and inwardly to the container support 8. It is thus possible, by a cooperation of the centering faces 14*b* of the different centering fingers 14 with the container edge 7*a*, to house the container 7 in the container support 8 so that the side face 7*b* of said container is at a predetermined distance from the internal side face 8*f* of support 8 and that the container edge 7*a* occupies also a predetermined position with respect to the upper horizontal face 8*a* of said support 8. In certain cases, it may be advantageous to provide at least some of the undercut generating parts 13 between two centering fingers or lugs 14, spaced more or less apart one from the other.

Other areas, such as 15, of the horizontal upper face 8*a*, comprised between two vertical centering fingers 14 can be so arranged as to avoid any undercut formation. In this case, the width of the horizontal upper face 8*a* of container support 8 is such that, given the position of the centering fingers 14 and of the container edge 7*a*, the vertical outer face or periphery of said container edge 7*a* coincides with the external edge of horizontal face 8*a* and consequently with the upper end of the external side face 8*c* of the container support 8 (FIG. 4, cross-section along line VII—VII, reference 15 and FIG. 7). It is in those areas 15 that the thermoformed lid 4 shows no undercut, but only a lateral skirt 4*b* joining up directly with the horizontal part 4*a* of said lid 4. Said areas 15 without undercut can exist either between two adjacent centering fingers 14, or between one centering finger 14 and one undercut area 13, or else between two undercut areas 13.

It is understood that the number and position of the undercuts 4*d* of the lid 4 are determined as a function of the sizes and general configuration of said lid 4 and so that, in the case of a removable and re-usable lid, the snap fitting of the lid 4 on the edge of the container 7*a* can be performed easily, reliably and without permanent deformation to the lid.

Figure 9:
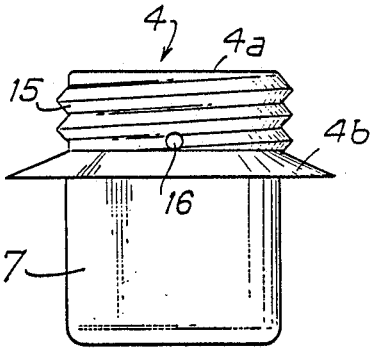
FIG. 9 is an elevational view of an axial section through a container equipped with a lid by means of the device according to FIG. 8.

The device used for producing the lids 4, illustrated in FIGS. 9 and 10, has the same general structure as the device shown in FIG. 1, centering of the container 7 with respect to the container support 8 being achieved via the inner side wall 8*f* thereof. When the lid 4 has no reinforcing rib and when, as a result, its upper horizontal face 4*a* is flat, the lower face 9*a* of support plate 9 is entirely plane and has no annular groove.

Figure 8:
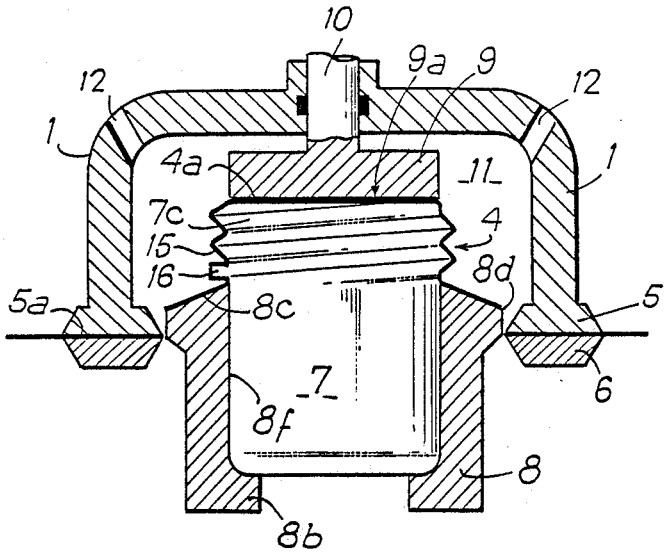
FIG. 8 is an elevational view through a number of elements of a device according to the invention, cooperating with a container of which the upper end is threaded.

According to the embodiment illustrated in FIGS. 8 and 9, container 7 is supported at its lower end by the lower part 8*b* of the container support 8 and projects by its coarsely threaded upper part 7*c* from the truncated upper face 8*c* of the container support 8, the outer lower part of which truncated face 8*c* coincides with the annular shoulder 8*d* which acts as a stamping edge with the die constituted by the lower edge 5 of the bell 1. When the container 7 covered by part of the thermoplastic band 3 occupies a position in which annular shoulder 8*d* is just below the level of the lower face 5*a* of the lower edge 5 of bell 1 (FIG. 2), it is possible to thermoform the lid 4 with an undercut thread 15 by applying compressed air into enclosure 11 through orifices 12, and the lid can be cut immediately after being formed (FIG. 8). The molded lid 4 can then be removed from container 7 by destroying the connection of a small locking tab 16 fast with the container 7 at the level of the threaded part 7*c*, and by unscrewing the lid 4 (FIG. 9), the truncated skirt 4*b* being joined to the threaded part 15.

Figure 11:
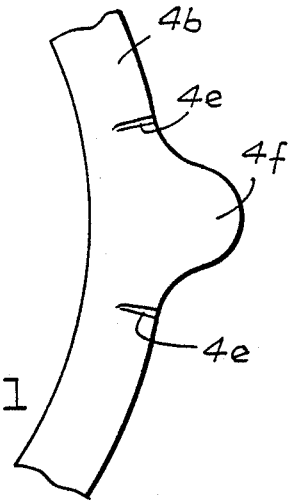
FIG. 11 shows a plan view of one detail of the lid according to FIG. 10.

According to the embodiment illustrated in FIG. 10, the container support 8 comprises an annular horizontal upper face of small width 8*a* which fits under the container edge 7*a* which is wider than said horizontal face 8*a* and which projects laterally outwardly thereof, a truncated outer face 8*c* joining up with the horizontal face 8*a* of the container support 8. As in the preceding example, the truncated outer face 8*c* of the upper part of container support 8 acts as a male mold for forming the lid 4 and its lower edge equivalent to the annular shoulder 8*d* of the example illustrated in FIGS. 1 to 7, acts as a stamping edge in cooperation with the edge of the die constituted by the lower edge 5 of the bell 1. Due to the fact that the container edge 7*a* projects entirely from the upper horizontal face 8*a* of the container support 8, the molded lid is a lid which has a continuous annular undercut 4*d* so that said lid 4 can only be removed after partial destruction thereof. To help such destruction, there is provided in the skirt 4*b* of the lid 4 at least one, and preferably two, tearing notches 4*e* and one gripping tab 4*f* (FIG. 11). This type of lid is particularly adapted to act as inviolable lids.

It is undertstood that the above-described embodiments can be modified in some ways by anyone skilled in the art without departing from the scope of protection such as defined in the accompanying claims. It should also be noted that for the sake of clarity, certain elements, non-essential to the invention, have been omitted from the description and the drawings, such as for example the support plates, also called ejectors, on which rest the containers when they are in a position such as illustrated in FIG. 1 and in which the upper end of the container is situated outside and just below the forming bell.

I claim:

1. Method for manufacturing and positioning an undercut plastic lid made from a thermoplastic band upon a container, comprising the steps of:

(a) applying a heated thermoplastic band against the lower edge of a forming bell with a holding clamp;

(b) locating a container in a support, said container overhanging the upper portion of said support;

(c) positioning the container and support beneath the part of the band delimited by the bell, and moving the container and support upwardly until the upper part of the support and the upper part of the container penetrate inside the bell, thereby stretching the heated band, the support cooperating with the bell to substantially close off the bell at the level of the lower face thereof, thus defining a stamping die or male forming mold for the part of the band between the inner lower edge of the bell and the upper container edge; and (d) creating a gas pressure inside an enclosure defined by the bell and the stretched band, and applying, under said pressure, the part of the band between the inner lower edge of the bell and the upper container edge against the outer face of the upper part of the container and the support.

2. Method as claimed in claim 1, additionally comprising cutting the thermoformed lid from the thermoplastic band while it is still under the forming bell.

3. Method as claimed in claim 1, additionally comprising forming at least one annular reinforcing rib on the upper flat face of the lid.

4. Method as claimed in claim 1, additionally comprising thermoforming a plurality of undercuts, separated by zones without undercuts, between the upper face of the lid and the lateral skirt thereof.

5. Method as claimed in claim 1, additionally comprising thermoforming an undercut threaded part between the upper face of the lid and the lateral skirt thereof.

6. Method as claimed in claim 1, additionally comprising thermoforming an annular undercut between the upper face of the lid and the lateral skirt thereof.

7. Device for manufacturing an undercut thermoplastic lid from a thermoplastic band, and positioning the lid upon a container, comprising:

(a) a forming bell having a lower annular edge and a means for connecting the bell to a source of pressurized gas;

(b) a lower holding clamp adapted to apply an annular area of a preheated thermoplastic band against the lower face of said lower annular edge;

(c) an annular support for the container having an upper part adapted to be partly overhung by the upper part of the container, said support being located under the bell and inside the periphery of the lower edge of the bell;

(d) means for moving said support upwardly to penetrate the bell, whereby the container and said support stretch the heated band; and (e) means for supplying gas connected to said bell, for creating inside the bell a gas pressure when said support has been moved upwardly to penetrate said bell, thereby applying the part of the band between the inner lower edge of said bell and the upper container edge against the outer face of the upper part of the container and said support.

8. Device as claimed in claim 7, additionally comprising a support plate arranged so as to be vertically movable inside the forming bell and being designed to cover the upper horizontal wall of the lid.

9. Device as claimed in claim 8, wherein the lower face of said support plate is provided with an annular groove of which the bottom is connected via a plurality of suction channels with a vacuum pump.

10. Device as claimed in claim 7, additionally comprising a lid cutting station under the forming bell.

11. Device as claimed in claim 10, wherein the cutting station comprises the annular shoulder of the container support acting as a cutting edge of a movable stamp and the inner edge of the lower end of the forming bell acting as a counter-cutting edge of a fixed stamping die.

12. Device as claimed in claim 7, wherein the container support has an upper horizontal face having a width which is constant and less than the width of the container edge.

13. Device as claimed in claim 12, wherein the horizontal upper face comprises zones of which the width is less than that of the container edge which extends outwardly from said horizontal upper face, as well as zones in which the periphery of the container edge coincides with the outer edge of the horizontal face.

14. Device as claimed in claim 7, wherein the container support comprises a plurality of vertical centering fingers designed to cooperate with the container edge.

* * * * *